US005725190A

United States Patent [19]

Cuthbertson et al.

[11] Patent Number: 5,725,190

[45] Date of Patent: Mar. 10, 1998

[54] SLOPED CEILING ADAPTOR

[75] Inventors: Jim Cuthbertson, Valinda; Ray Chin, Philips Ranch; Craig Chandler, Huntington Beach, all of Calif.

[73] Assignee: Hunter Fan Company, Memphis, Tenn.

[21] Appl. No.: 356,142

[22] Filed: Dec. 15, 1994

[51] Int. Cl.[6] ..... B42F 13/00

[52] U.S. Cl. ..... 248/343; 248/317

[58] Field of Search ..... 248/343, 342, 248/207, 317, 237, 220.1, 906; 52/39; 362/404, 421, 369

[56] References Cited

U.S. PATENT DOCUMENTS

| | | | |
|---|---|---|---|
| 3,302,918 | 2/1967 | Cohen | 362/404 |
| 3,381,123 | 4/1968 | Docimo | 362/366 |
| 4,729,080 | 3/1988 | Fremont et al. | 362/366 |
| 4,988,067 | 1/1991 | Propp et al. | 248/343 |
| 5,034,869 | 7/1991 | Choi | 362/363 |
| 5,124,901 | 6/1992 | Sojka et al. | 362/366 |
| 5,221,069 | 6/1993 | Struthers et al. | 248/343 |
| 5,349,513 | 9/1994 | Taylor, III | 362/404 |
| 5,452,193 | 9/1995 | Hinnefeld et al. | 362/366 |
| 5,457,617 | 10/1995 | Chan et al. | 362/366 |

*Primary Examiner*—Leslie A. Braun
*Assistant Examiner*—Anita M. King
*Attorney, Agent, or Firm*—Baker, Donelson, Bearman & Caldwell

[57] ABSTRACT

An adaptor assembly makes it possible to mount an electric fixture, such as a ceiling fan or electric lighting fixture, to a ceiling with a slope greater than 32°. The adaptor assembly includes a slope angle extension cover formed as a truncated conical surface with a bottom end lying in a first plane adapted for attachment to a standard fixture canopy and a top end lying in a second plane at an angle of 26° to the first plane and adapted to be attached through an adaptor mounting plate to a junction box mounted in a recess in the ceiling.

The mounting plate has a plurality of radial slots and is rotated to bring a pair of slots in alignment with screw holes in mounting lugs on the junction box for attachment with screws. The mounting plate has a pair of deformations providing flat wall portions which, when the mounting plate is installed are in parallel to the bottom end of the extension cover. A pair of screws each extend through the flat wall portion of a deformation and a screw hole provided through the bottom end of the cover to mount the cover with the top end confronting and parallel to the sloped ceiling. An insulation disk is sandwiched between the mounting plate and the ceiling and is secured to the mounting plate by a pair of adhesive tabs.

15 Claims, 5 Drawing Sheets

SLOPED CEILING ADAPTOR

BACKGROUND OF THE INVENTION

1. Field of the Invention

This invention relates to adaptors for adapting a ceiling fan or light fixture mounting to highly sloped ceilings, and more particularly, to ceilings with slopes in excess of 32 degrees.

2. Description of the Prior Art

It is customary to mount ceiling fans and light fixtures on sloped ceilings which do not exceed a 32 degree angle with the horizontal. Such mountings comprise a standard mounting canopy which is mounted to the ceiling by bolting the canopy to a crossbar mounting bracket mounted on the ceiling beneath a junction box installed in the ceiling. At its lower end, the standard canopy provides a socket which cooperates with a ball to form a ball and socket joint. The ball is formed on the top end of a shaft, on the lower end of which the ceiling fan or lighting fixture is mounted.

Although the ball and socket joint provides satisfactory accommodation to the slope of the ceiling when the slope does not exceed 32 degrees with the horizontal, for slopes which exceed 32 degrees, the mounting is no longer satisfactory.

SUMMARY OF THE INVENTION

It is accordingly the object of the invention to provide an adaptor to make it possible to mount a ceiling fan or lighting fixture from a ceiling with a slope which exceeds 32 degrees.

To this end, the invention contemplates the provision of a slope angle extension cover formed as a truncated conical surface having a bottom end lying in a first plane and adapted for attachment to a standard fixture, such as a ceiling fan or lighting fixture, and a top end lying in a second plane at an angle of 26° to the first plane and adapted for attachment to a junction box mounted in a recess in the ceiling. In order to mount the extension cover from the junction box, an adaptor mounting plate is provided. The mounting plate is a disk, which is smaller in extent than the top end of the extension cover, and has a plurality of radial slots. By adjusting the rotational position of the mounting plate, a pair of the radial slots may be aligned with screw holes on mounting lugs provided on the junction box; the slots and screw holes then receive screws for attaching the mounting plate to the junction box. To facilitate mounting the extension cover on the mounting plate, a pair of deformations are provided on opposite sides of the mounting plate on a diametric line. The deformations have a flat surface portion which is parallel to the bottom side of the extension cover. When the mounting plate is attached to the junction box, the deformations are positioned at the same height on the ceiling. Mounting screws are then positioned through aligned holes provided in the bottom end of the extension cover and through the flat surface portion of a corresponding deformation.

When the adaptor mounting plate is attached to the junction box, an insulation disk, which is larger than the mounting plate but fits within the top end of the extension cover, is sandwiched between the mounting plate and the ceiling, being attached to the mounting plate by a pair of adhesive pads.

BRIEF DESCRIPTION OF THE DRAWINGS

A clearer understanding of the invention will be apparent from the following description and drawings, wherein.

DETAILED DESCRIPTION

Figure 1:
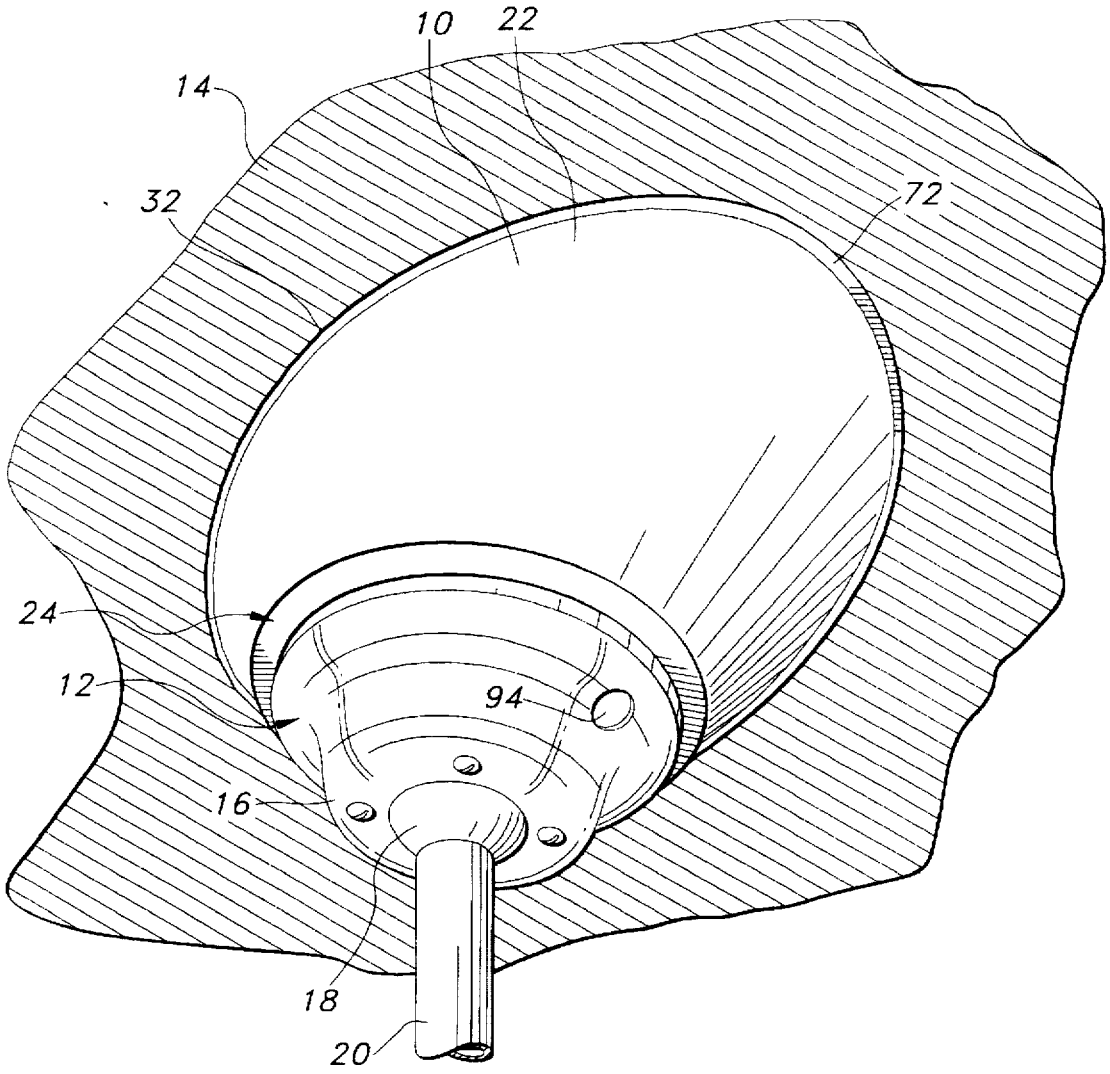
FIG. 1 is a perspective view showing a slope angle extension cover of the invention mounting a standard fixture on a highly sloped ceiling.

Turning to FIG. 1, a sloped ceiling adaptor assembly of the invention includes a ceiling adaptor cover 10 shown mounting a standard fixture 12 to a highly sloped ceiling 14. The standard fixture includes an inverted bell-shaped canopy 16 having a ball 18 of a ball and socket connection on a support rod 20 of a standard fixture, such as a ceiling fan or an electric lighting fixture (not shown).

Figure 4:
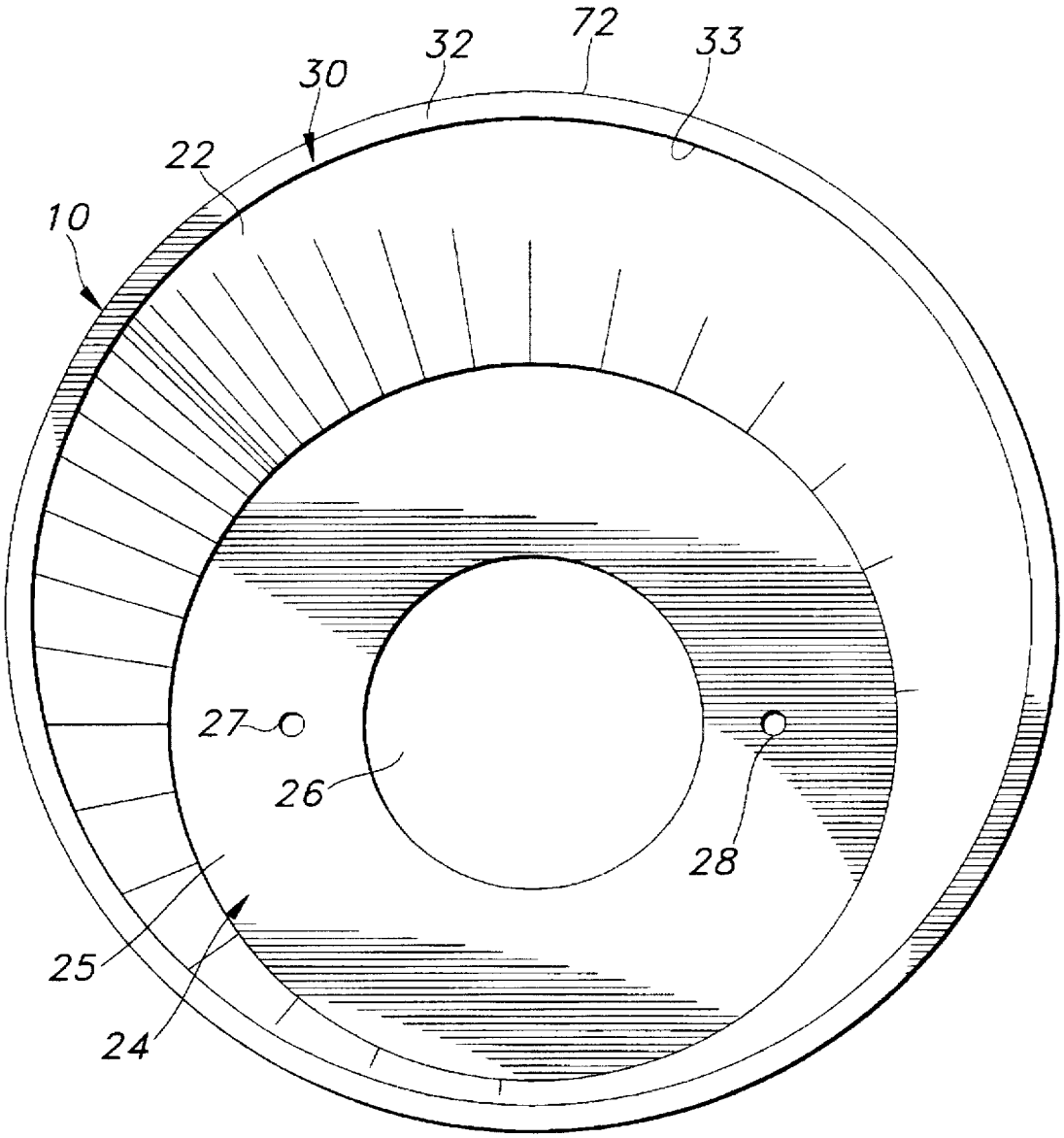
FIG. 4 is a top view of the extension cover.

As seen in FIG. 4, ceiling adaptor cover 10 has a truncated conical wall 22 with a bottom end 24 having a flat wall 25 with a central opening 26 and a pair of screw holes 27 and 28 on a common diametric line which is perpendicular to the widest dimension of the cover (the vertical as seen in FIG. 4). Cover 10 has an oval top end 30 which is larger than bottom end 24 and includes an outwardly extending narrow rim 32. The inner edge 33 of rim 32 defines a large opening at top end 30.

Figure 2:
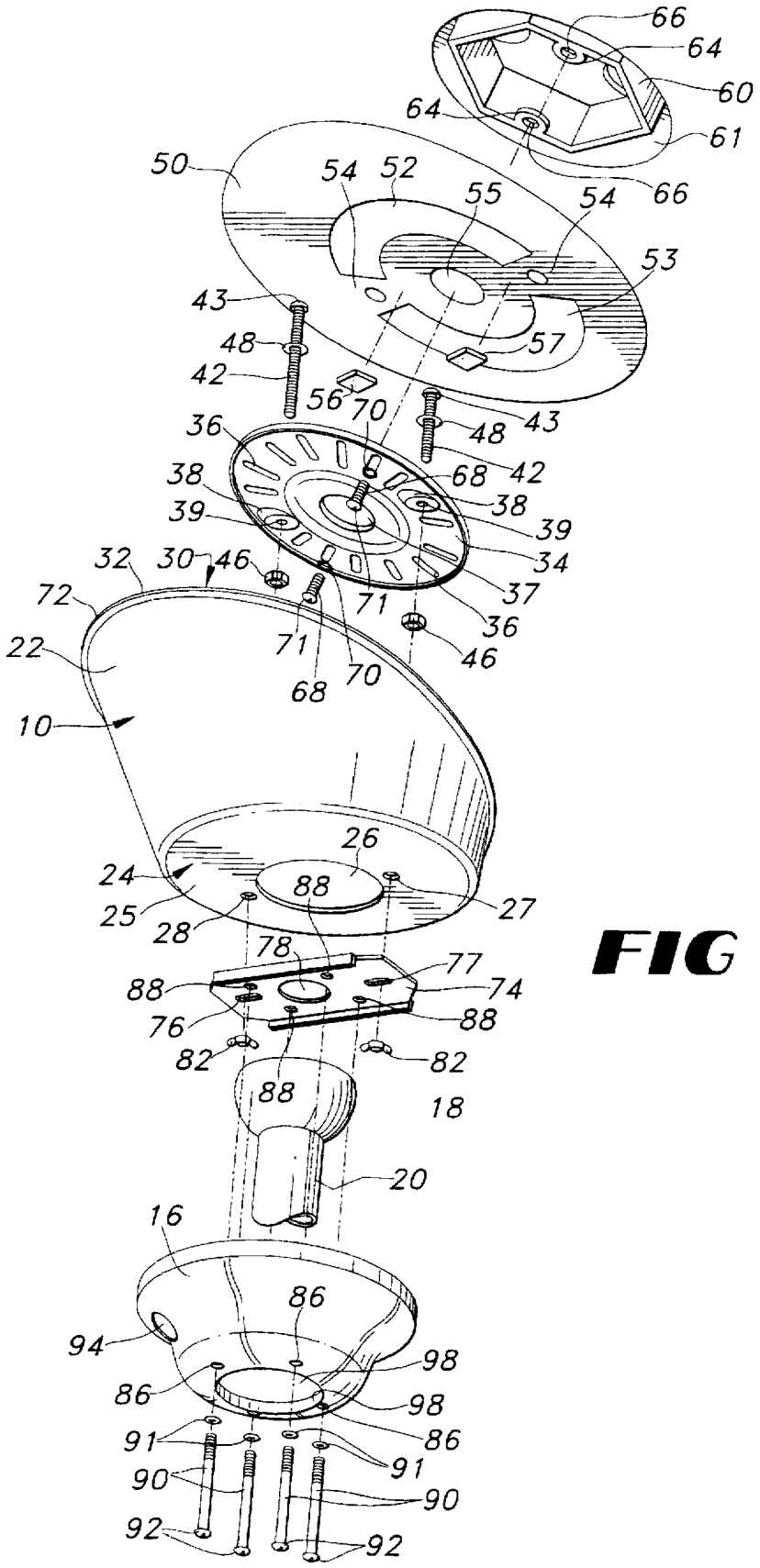
FIG. 2 is an exploded view showing a sloped ceiling adaptor of the invention mounting a standard fixture to a highly sloped ceiling.
Figure 5:
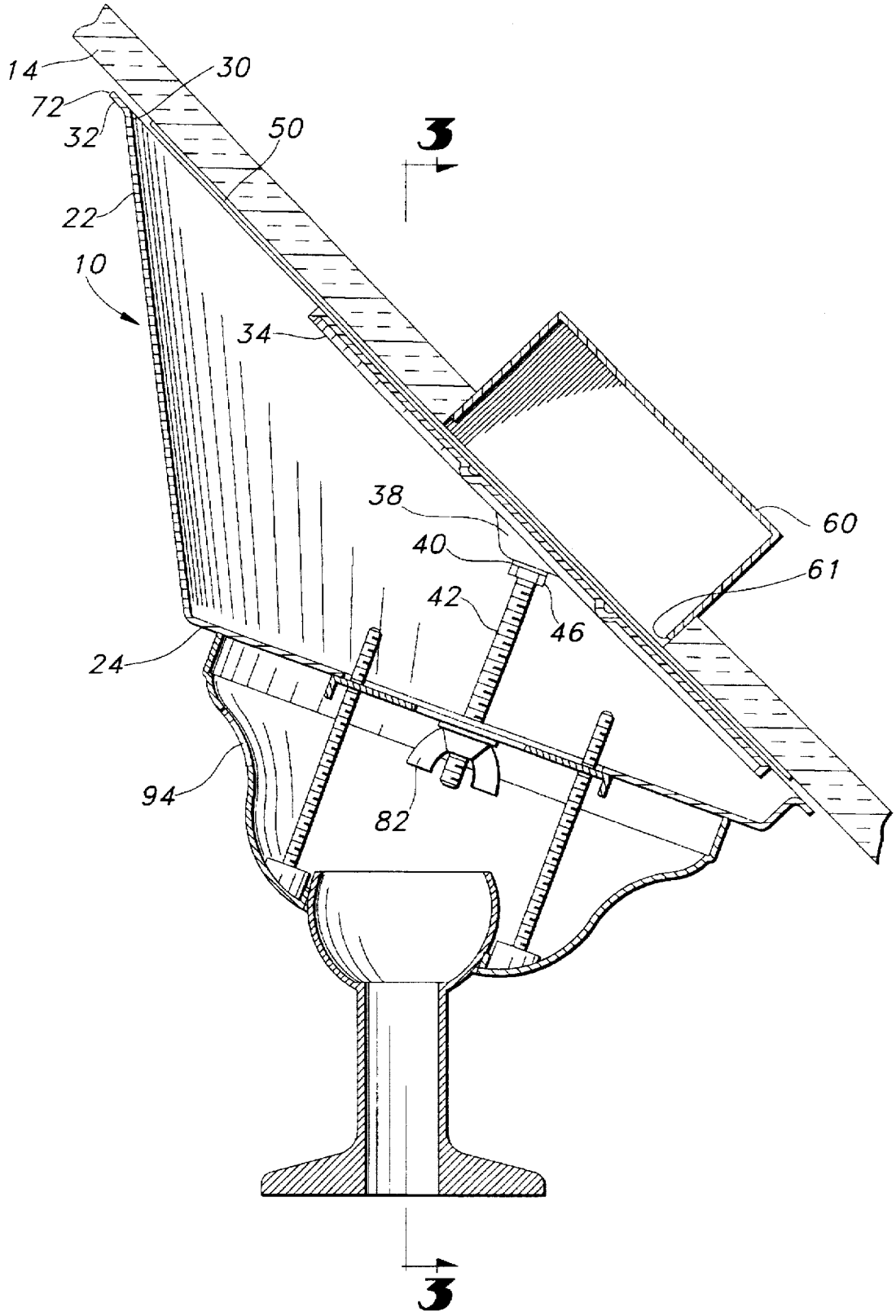
FIG. 5 is a cross-section view showing a sloped ceiling adaptor assembly of the invention mounting a standard fixture to a highly sloped ceiling.

As seen in FIG. 2, an adaptor mounting plate 34 is in the form of a metal disk having two sets of seven equally spaced radial mounting slots 36 and a central circular opening 37 to accommodate wiring to the fixture from a junction box 60 mounted in a recess 61 in the ceiling. Between each set of slots are a pair of deformations 38 having a screw holes 39 located on common diametric line of mounting plate 34. As seen in FIG. 5, each deformation 38 includes a flat wall portion 40, which, when mounting plate 34 is mounted in confronting relation and parallel to ceiling 14, is parallel to bottom end 24 of adaptor cover 10. A pair of screws 42, only one of which is visible in FIG. 5, connect adaptor cover 10 to mounting plate 34. Each screw 42 extends through a screw hole 39 through flat wall portion 40 of a corresponding deformation 38 and through a screw hole 27 or 28 through bottom end wall 25 (see FIG. 2). The screws are secured by flange nuts 46, and flat washers 48 are used under the heads 43 of screws 42.

An oval insulated disk 50 is sandwiched between mounting plate 34 and ceiling 14 as seen in FIG. 5. Disk 50 is dimensioned to just fit within rim 32 at top end 30 of adaptor cover 10. As seen in FIG. 2, insulation disk 50 has a pair of arcuate openings 52 and 53 separated by ribs 54. Openings 52 and 53 are positioned to overlie respective sets of slots 36. The disk also has a circular opening 55 positioned in alignment with central opening 37 of mounting plate 34. A pair of adhesive pads 56 and 57 are used to secure insulation disk 50 to mounting plate 34.

The installation of the adaptor assembly of the invention will be best understood from the exploded view of FIG. 2.

A flat washer 48 is placed on each screw 42 before it is installed on adaptor plate 34. Each screw 42 is then extended through a screw hole 39 in flat wall portion 40 of a deformation 38, while making sure that screw head 43 and washer 48 are seated inside adaptor plate deformation 38. Flange nuts 46 are then threaded onto screws 42 all the way down to wall 40 of mounting plate 34 and are tightened securely.

In order to secure insulation disk 50 to mounting plate 34, adhesive patches 56 and 57 are placed on each side of center hole 55 in line with ribs 54. Insulation disk 50 is then positioned with center hole 55 lined up with center hole 37 of mounting disk 34 and with ribs 54 over deformations 38 and firmly pressed to attach disk 50 to plate 34.

Mounting plate 34 is then aligned with junction box 60 mounted in recess 61 in ceiling 14 (see FIG. 5). Junction box 60 includes mounting tabs 64 having screw holes 66. Mounting plate 34 is rotated until a pair of slots 36 line up with junction box screw holes 66. Although the ceiling adaptor of the invention works best when mounting screws 42 are aligned horizontally, it may not be possible, due to the type and structural details of junction box 60, to align screws 42 perfectly on the same horizontal line. However, the adaptor of the invention is designed to work well in situations in which screws 42 are as much as 20° out of alignment with the horizonal. If there is misalignment, the greater the deviation from the horizontal, the smaller is the slope angle that can be reduced by the adaptor. After a pair of slots 36 are aligned with junction box screw holes 66, screws 68 with flat washers 70 positioned under screw heads 71 are extended through slots 36 and threaded with screw holes 66 through junction box mounting lugs 64. Since further adjustment may be necessary, screws 68 should not be over tightened.

In order to verify that the point 72 of ceiling adaptor cover (the point on rim 32 which is the greatest distance from bottom end 24) is pointed toward the peak of the room, ceiling adaptor 10 is held with screw holes 27 and 28 slipped on screws 42. If adaptor cover 10 does not so line up, it will be necessary to return to the adaptor mounting plate rotation step to rotate mounting plate 34 to bring another pair of slots in alignment with junction box mounting holes 66.

If cover point 72 is pointed to the peak of the room, a crossbar mounting bracket 74, which is a conventional fan mounting bracket, is slipped on screws 42. To facilitate this, bracket 74 has a pair of screw receiving slots 76 and 77 at opposite ends. Bracket 74 also has a central wire receiving opening 78. A set of wires (not shown) from junction box 60 are extended through opening 78 and are lengthened for this purpose if necessary. To secure bracket 74 in place, wing nuts 82 are threaded onto screws 42 protruding through screw holes 27 and 28 in cover bottom wall 25 and through mounting bracket slots 76 and 77. The nuts are tightened securely, but are not over tightened.

The next step is the installation of conventional inverted bell-shaped canopy 16. Pursuant to the usual practice, canopy 16, which has four screw holes 86, is rotated to bring screw holes 86 in alignment with a set of four screw holes 88 through bracket 74. Screws 90, with lock washers 91 positioned under screw heads 92, are then inserted through screw holes 86 and threaded with screw holes 88. An opening 94 is provided in the side of canopy 16 pointing toward the ceiling peak. This provides means for feeding out the wiring from junction box 60 for connection to the ceiling fan or other electrical fixture supported by canopy 16.

Figure 3:
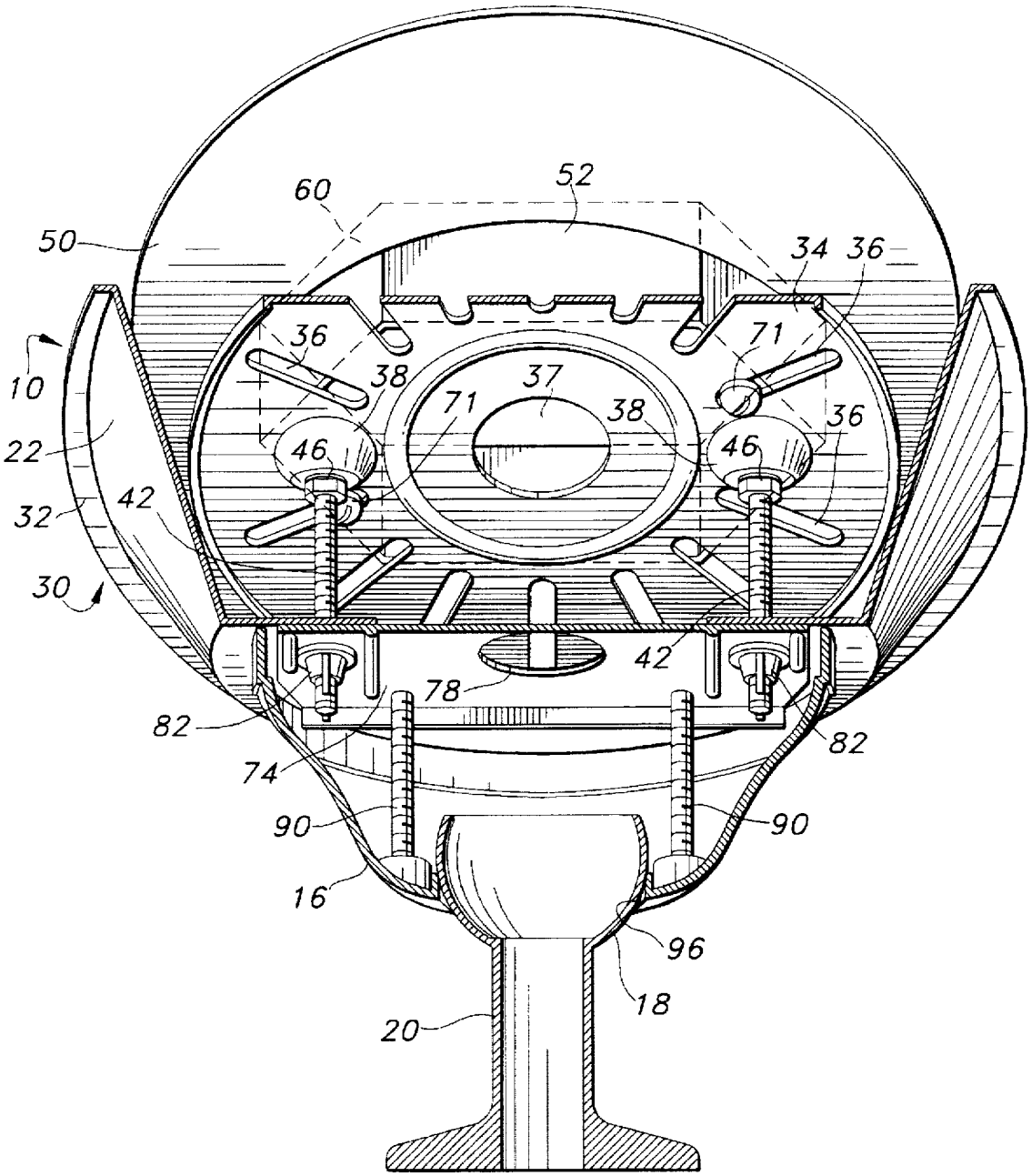
FIG. 3 is a view, partially broken away and partially in section, of the adaptor assembly of the invention mounted from a junction box in the ceiling and supporting a standard fixture.

A socket 96 is provided at the bottom end of canopy 84 surrounding central opening 98. Ball 18 at the top of fan, or fixture, support rod 20 completes the ball and socket joint. It will be understood that ball 18 will be engaged with socket 96 of canopy 16, as shown in FIGS. 1, 3 and 5, before connection of canopy 16 to bracket 74.

With the adaptor assembly installed as described, the mounting of the fan or lighting fixture is readily accommodated to a highly sloped ceiling. To the angular adjustment provided by the ball and socket joint of the conventional mounting, there is added the additional angular adjustment provided by the adaptor assembly.

Although the invention has been described with reference to a particular embodiment, it is to be appreciated that various adaptations and modifications maybe made within the spirit of the invention.

The invention claimed is:

1. An adaptor mounting plate for mounting a slope angle extension cover to a ceiling having a slope greater than 32 degrees, said extension cover having a top end to be positioned parallel to said mounting plate and a bottom end at an angle to said top end, said mounting plate comprising:

a body, a portion of said body including a set of radial slots adapted to receive screw means for attaching said body to a junction box mounted in a recess in said ceiling so that a rotational position of said body can be easily adjusted for alignment of a pair of said slots with screw receiving holes provided on said junction box; and a pair of deformations of said body each having a side wall portion and a bottom wall portion extending at oblique angles to the portion of said body which includes said radial slots for alignment of said bottom wall portions of said deformations parallel to said bottom end of said extension cover when said cover is mounted on said body, holes being provided through said bottom wall portions of said deformations for receiving screw means for attaching said extension cover to said body in such a manner that the mounting angle of the ceiling is reduced and the top end of the extension cover extends substantially parallel to said portion of said body including said radial slots and the bottom end of the extension cover extends substantially parallel to said bottom wall portions of said deformations.

2. A slope angle extension cover comprising:

a circular shaped bottom end defining a planar surface including a reduced diameter opening adapted for suspending an electrical fixture below said bottom end from a ceiling having a slope of greater than 32 degrees, said bottom end lying in a first plane;

an oval shaped top end for being positioned on the ceiling and extending parallel to the ceiling, said top end lying in a second plane at an angle to said first plane; and a truncated conical wall extending between said bottom and top ends.

3. An adaptor assembly for suspending an electric fixture from a junction box disposed within a ceiling having a slope greater than 32 degrees, said electric fixture having wiring which connects with a source of electricity, said adaptor assembly comprising:

an extension cover having a truncated conical side wall with a top edge and a bottom edge and a bottom end with an outer perimeter and an inner perimeter spaced inwardly from said bottom edge of said side wall, the inner perimeter of said bottom end and the top edge of said side wall defining openings for receiving said wiring, the bottom edge of said side wall being adjoined to the outer perimeter of said bottom end, the top edge of said side wall lying in a first plane for extending said top edge parallel to the slope of said ceiling when the extension cover is mounted below the ceiling and said bottom end lying in a second plane which is at an angle to said first plane; and a mounting plate including at least one first opening for connecting the mounting plate to the junction box and a plurality of second openings defined in wall portions extending parallel to said second plane when said extension cover is mounted on said mounting plate for adjustably connecting the mounting plate to the extension cover, said first and second openings cooperating in such a manner that the extension cover is alignable with the slope of the ceiling to reduce the mounting angle of the ceiling whereby the electric fixture is suspended from the ceiling in a substantially vertical position.

4. The adaptor assembly of claim 3, further comprising a flat insulation disk for mounting between the mounting plate and the junction box.

5. The adaptor assembly of claim 3, wherein the angle between the first plane and the second plane is 26 degrees.

6. The adaptor assembly of claim 3, wherein said mounting plate is in the shape of a substantially planar disk.

7. The adaptor assembly of claim 6, wherein each of the second openings are defined by a deformation in the mounting plate, said deformation having a flat wall portion which is parallel to the bottom end of the extension cover.

8. The adaptor assembly of claim 3, wherein the first openings comprise a plurality of radially elongated slots.

9. The adaptor assembly of claim 3, wherein the top edge is generally oval in shape.

10. The adaptor assembly of claim 3, wherein the extension cover further comprises an outer rim adjoining the top edge.

11. The adaptor assembly of claim 3, wherein the side wall of the extension cover has a generally conical shape.

12. The adaptor assembly of claim 4, wherein the insulation disk is generally oval in shape.

13. The adaptor assembly of claim 4, wherein the insulation disk is secured to the mounting plate by an adhesive.

14. The adaptor assembly of claim 13, wherein said adhesive means is at least one adhesive patch positioned between the insulation disk and the mounting plate.

15. An adaptor assembly for suspending a ceiling fan having an extension rod from a junction box disposed within a ceiling having a slope greater than 32 degrees, said ceiling fan having and wiring which connects with a source of electricity, said adaptor assembly comprising:

an extension cover having a side wall with a top edge and a bottom edge and a bottom end with an outer perimeter and an inner perimeter spaced inwardly from said bottom edge of said side wall, the inner perimeter of said bottom end and the top edge of said side wall defining openings for receiving said wiring, the bottom edge of said side wall being adjoined to the outer perimeter of said bottom end, the top edge of said side wall lying in a first plane for extending parallel to the slope of said ceiling when the extension cover is mounted below the ceiling and said bottom end lying in a second plane which is at an angle of 26 degrees to said first plane;

a mounting plate including at least one first opening for connecting the mounting plate to the junction box and a plurality of second openings defined in wall portions extending parallel to said second plane when said extension cover is mounted on said mounting plate for adjustably connecting the mounting plate to the extension cover, said first and second openings cooperating in such a manner that the extension cover is alignable with the slope of the ceiling to reduce the mounting angle of the ceiling whereby the ceiling fan is suspended from the ceiling in a substantially vertical position;

a flat insulating disk fitting within said top edge of said extension cover for mounting between the mounting plate and the junction box; and an adhesive for securing the insulating disk to the mounting plate.

* * * * *